US010248127B2

(12) United States Patent
Taylor et al.

(10) Patent No.: US 10,248,127 B2
(45) Date of Patent: Apr. 2, 2019

(54) SYSTEMS AND METHODS FOR PILE SPACING

(71) Applicant: Caterpillar Inc., Peoria, IL (US)

(72) Inventors: Michael A. Taylor, Wexford, PA (US); Steven E. Empson, East Peoria, IL (US); Mo Wei, Dunlap, IL (US)

(73) Assignee: Caterpillar Inc., Deerfield, IL (US)

( * ) Notice: Subject to any disclaimer, the term of this patent is extended or adjusted under 35 U.S.C. 154(b) by 143 days.

(21) Appl. No.: 15/602,230

(22) Filed: May 23, 2017

(65) Prior Publication Data

US 2018/0341268 A1 Nov. 29, 2018

(51) Int. Cl.

| | |
|---|---|
| ***E02F 1/00*** | (2006.01) |
| ***G05D 1/02*** | (2006.01) |
| ***E02F 3/76*** | (2006.01) |
| ***E02F 3/84*** | (2006.01) |
| ***E02F 9/26*** | (2006.01) |
| ***E02D 3/02*** | (2006.01) |
| *E01C 19/28* | (2006.01) |

(52) U.S. Cl.

CPC ..... *G05D 1/0219* (2013.01); *E02D 3/02* (2013.01); *E02F 1/00* (2013.01); *E02F 3/7604* (2013.01); *E02F 3/841* (2013.01); *E02F 9/261* (2013.01); *G05D 1/0227* (2013.01); *E01C 19/282* (2013.01); *G05D 1/0257* (2013.01); *G05D 2201/0202* (2013.01)

(58) Field of Classification Search

USPC ..... 701/50

See application file for complete search history.

(56) References Cited

U.S. PATENT DOCUMENTS

| | | | | |
|---|---|---|---|---|
| 6,502,016 | B1 | 12/2002 | Ozaki et al. | |
| 7,509,198 | B2 | 3/2009 | Shull et al. | |
| 9,297,147 | B1 | 3/2016 | Wei et al. | |
| 2004/0158355 | A1 | 8/2004 | Holmqvist et al. | |
| 2017/0138016 | A1* | 5/2017 | Wei | E02F 9/2045 |
| 2018/0088591 | A1* | 3/2018 | Friend | E02F 9/205 |
| 2018/0163376 | A1* | 6/2018 | Redenbo | E02F 9/262 |

* cited by examiner

*Primary Examiner* — Genna M Mott

(57) ABSTRACT

A method for depositing piles of material, by a machine, in a work zone of a worksite. The method comprising detecting, by a controller, a first area occupied by a first pile deposited in the work zone, determining, by the controller, an available area in the work zone based on a comparison of the first area with an area of the work zone, determining, by the controller, a remaining number of piles to be deposited in the available area based on the determination of the available area, determining, by the controller, a location for each pile of the remaining number of piles to be deposited in the available area such that each pile of the remaining number of piles are evenly spaced from each other; and generating, by the controller, a machine signal to operate the machine to form the remaining number of piles at the respective determined location.

20 Claims, 15 Drawing Sheets

SYSTEMS AND METHODS FOR PILE SPACING

TECHNICAL FIELD

The present disclosure generally relates to a machine for forming a pile of material at a worksite. More particularly, the present disclosure relates to systems and methods for controlling spacing of multiple piles formed by the machine.

BACKGROUND

Dozer machines are used to move material and/or alter work surfaces at a worksite. Such machines may be configured to push material and form piles at a location on the worksite. It is sometimes desired to have a certain number of piles, which are substantially of equal size (for example, similar height), to be positioned at regular intervals along a defined distance. Subsequently, the piles are then compacted to form a new surface layer, upon which another sequence of piles may be positioned.

However, in operation the dozer may not form piles of equal sizes due to variables such as depressions on the work surface, shedding of material, etc. Accordingly, piles of varying sizes may be positioned at regular intervals along a defined distance. Compaction of such piles may form an uneven surface, which may be undesirable.

U.S. Pat. No. 9,297,147 (hereinafter referred to as U.S. Pat. No. 9,297,147) relates to a semi-autonomous tractor system. U.S. Pat. No. 9,297,147 discloses a control system for a semi-autonomous tractor. The control system is configured to identify a crest on a worksite and issue a command to the machine to remove/cut the crest.

SUMMARY OF THE INVENTION

In an aspect of the present disclosure, a method for depositing piles of material, by a machine, in a work zone of a worksite is disclosed. The method includes detecting, by a controller, a first area occupied by a first pile deposited in the work zone, determining, by the controller, an available area in the work zone based on a comparison of the first area with an area of the work zone, determining, by the controller, a remaining number of piles to be deposited in the available area based on the determination of the available area, determining, by the controller, a location for each pile of the remaining number of piles to be deposited in the available area such that each pile of the remaining number of piles are evenly spaced from each other; and generating, by the controller, a machine signal to operate the machine to form the remaining number of piles at the respective determined location.

In another aspect of the present disclosure, a pile spacing system for a machine operating at a worksite is disclosed. The pile spacing system includes a controller operatively coupled to the machine. The controller is configured to detect a first area occupied by a first pile deposited in a work zone, in the worksite, determine an available area in the work zone based on a comparison of the first area with an area of the work zone, determine a remaining number of piles to be deposited in the available area based on the determination of the available area, determine a location for each pile of the remaining number of piles to be deposited in the available area such that each pile of the remaining number of piles are evenly spaced from each other and generate a machine signal to operate the machine to form the remaining number of piles at the respective determined location in the available area.

In yet another aspect of the present disclosure, a machine configured to operate at a worksite is disclosed. The machine includes a controller operatively coupled to the machine. The controller is configured to detect a first area occupied by a first pile deposited in a work zone, in the worksite, determine an available area in the work zone based on a comparison of the first area with an area of the work zone, determine a remaining number of piles to be deposited in the available area based on the determination of the available area, determine a location for each pile of the remaining number of piles to be deposited in the available area such that each pile of the remaining number of piles are evenly spaced from each other, generate a machine signal to operate the machine to form the remaining number of piles at the respective determined location in the available area.

DETAILED DESCRIPTION

Reference will now be made in detail to embodiments of the disclosure, examples of which are illustrated in the accompanying drawings. Wherever possible, the same reference numbers will be used throughout the drawings to refer to the same or like parts.

Figure 1:
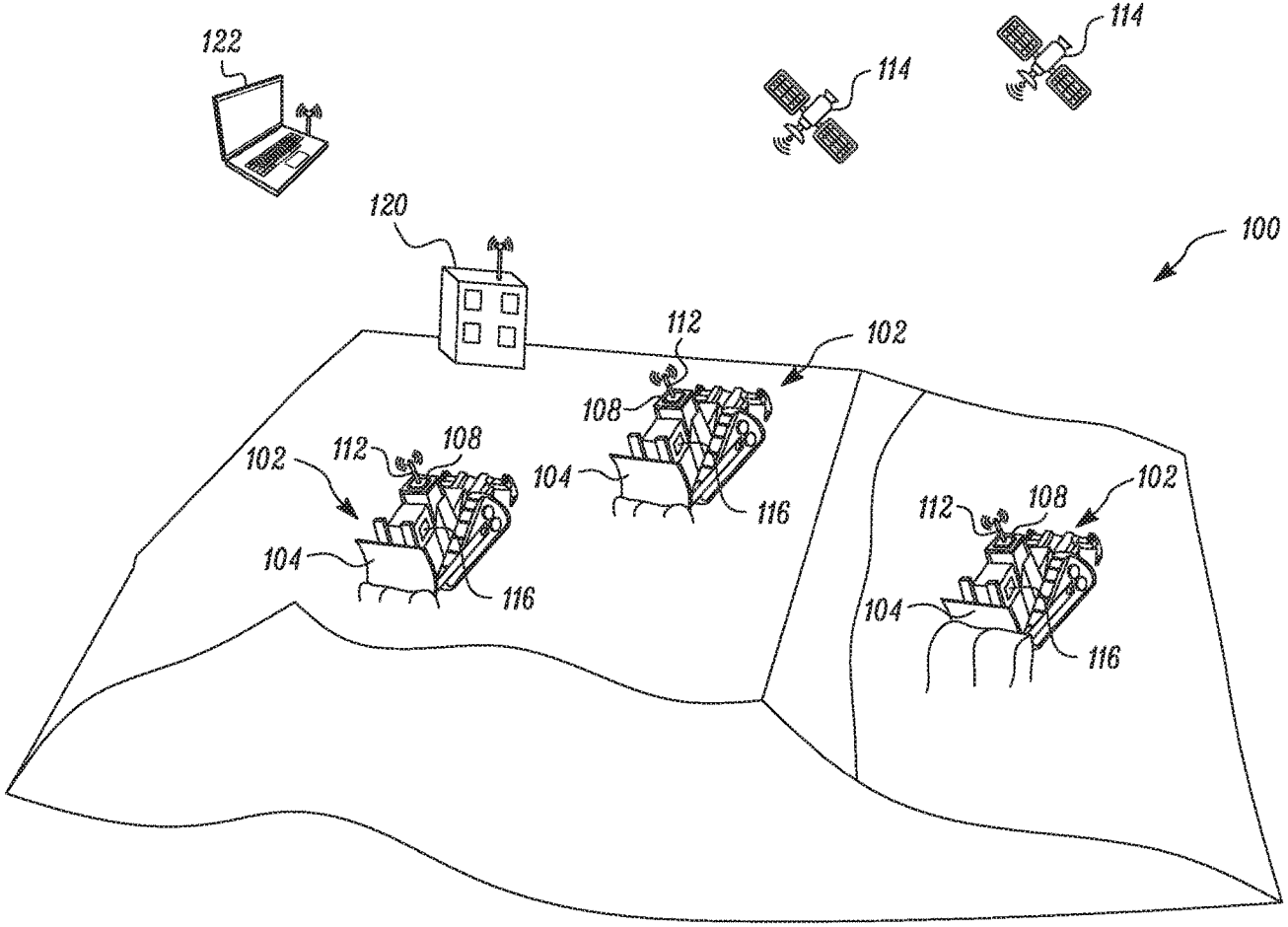
FIG. 1 is a diagrammatic illustration of at least one exemplary machine working at a worksite.
Figure 2:
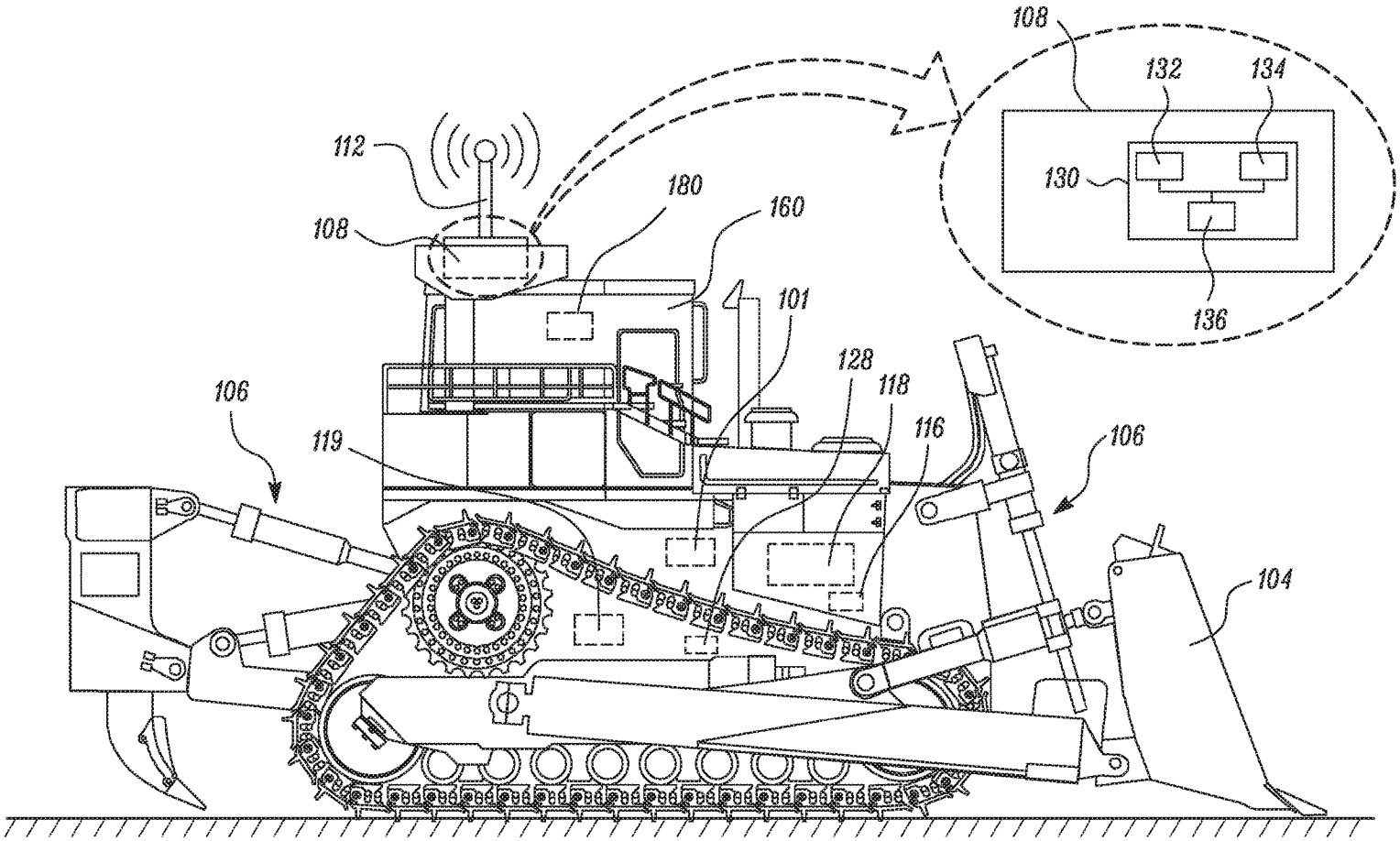
FIG. 2 is a diagrammatic illustration of the at least one machine.

Referring now to FIG. 1, an exemplary worksite 100 is illustrated with one or more machines 102 performing predetermined tasks. The worksite 100 may include, for example, a mine site, a landfill, a quarry, a construction site, or any other type of worksite. The predetermined task may be associated with altering the geography at the worksite 100, such as a dozing operation, a grading operation, a leveling operation, a bulk material removal operation, or any other type of operation that results in geographical modifications within the worksite 100. The machines 102 may be mobile machines configured to perform operations associated with industries related to mining, construction, farming, or any other industry known in the art. The machines 102 depicted in FIG. 1, for example, may embody earth moving machines, such as dozers having blades or other work tools or work implements 104 movable by way of one or more actuators 106 (as shown in FIG. 2). In an embodiment, the machines 102 may be a manned machine. In an alternate embodiment, the machine 102 may be a machine known in the art with various level of autonomy, such as a semi-autonomous machine, a remotely operated machine, or remotely supervised machine.

Each machine 102 may include one or more of a variety of machine sensors. For example, each machine 102 may include a locating device 112 configured to communicate with one or more satellites 114. The one or more satellites 114 may communicate information pertaining to the position and/or orientation of the machines 102 relative to the worksite 100, to a control system 108. Referring to FIG. 2, each machine 102 may additionally include one or more implement sensors 116 configured to track and communicate position and/or orientation information of the work implement 104 to the control system 108. Further, each machine 102 may also include an engine sensor 118 configured to measure a torque produced by an engine 101 of the machine 102. The machine 102 may further include a slip sensor 119 configured to measure a slip factor of the machine 102 i.e. the relative movement of the machine 102 with respect to the ground relative to torque produced by the engine 101 of the machine 102. The machine 102 may also include a perception module 128. The perception module 128 may include at least one perception sensor (not shown). For example, in certain embodiments the perception module 128 may include a light detection and ranging (LIDAR) device. In various other embodiments, the perception module 128 may include perception sensors such as RADAR (radio detection and ranging) device, a stereo camera, a monocular camera, or another device known in the art.

The perception module 128 is configured to generate perception data of the worksite 100. The perception data obtained from the perception module 128 may be used to determine the terrain and geometrical properties of the worksite 100. The perception data along with the position co-ordinates obtained from a position detection device (may be the locating device 112) may be used to generate a terrain map for the worksite 100 including identifying the terrain features of the worksite 100, such as a crest, a trough, a wall, spill pile, cuttings pile, high fidelity ground, etc. The position detection device may be any one or a combination of a Global Positioning System (GPS), a Global Navigation Satellite System, a Pseudolite/Pseudo-Satellite, any other Satellite Navigation System, an Inertial Navigation System or any other known position detection system known in the art.

The overall operations of the machines 102 and the work implements 104 within the worksite 100 may be managed by the control system 108 present in the one or more machines 102. The control system 108 may be at least partially in communication with the machines 102. The control system 108 may be configured to receive relevant machine information from the one or more of the variety of machine sensors (i.e. the locating device 112, the implement sensors 116, the engine sensor 118, the slip sensor 119 and the perception module 128).

Referring again to FIG. 1, the control system 108 may be implemented in any number of different arrangements. For example, the control system 108 may be at least partially implemented at a command center 120 situated locally or remotely relative to the worksite 100 with sufficient means for communicating with the machines 102, for example, via satellites 114, or the like. Additionally or alternatively, the control system 108 may be implemented using one or more computing devices 122 with means for communicating with one or more of the machines 102 or one or more command centers 120 that may be locally and/or remotely situated relative to the worksite 100. Other suitable modes of implementing the control system 108 are possible and will be understood by those of ordinary skill in the art. Using any of the foregoing arrangements, the control system 108 may generally be configured to monitor the positions/locations of the machines 102 and/or work implements 104 relative to the worksite 100 and a predetermined target operation.

The control system 108 includes a pile spacing system 130, as illustrated in FIG. 2. The pile spacing system 130 includes a controller 132, a memory 134, and a communication device 136.

The controller 132 may be configured to operate according to one or more algorithms. The controller 132 may include any one or more of a processor, a microprocessor, a microcontroller, or any other suitable means for executing instructions/algorithms/computations. The algorithms/instructions may be retrievably stored within the memory 134. The memory 134 may be provided on-board the controller 132 or external to the controller 132. The memory 134 may include non-transitory computer-readable medium or memory, such as a disc drive, flash drive, optical memory, read-only memory (ROM), or the like.

The controller 132 may be operably coupled to the communication device 136. The communication device 136 facilitates as a means to communicate with one or more of the machines 102, and provides information pertaining to the position and/or orientation of the machines 102 and the work implement 104, for example, via satellites 114, or any other suitable means of communication, to the controller 132.

The controller 132 is operably coupled to the machine 102. The controller 132 is configured to provide instructions for controlling the machines 102 and/or work implement 104 in an efficient manner in executing the target operation. For example, the controller 132 may be configured to generate signals to operate the one or more machines 102 to excavate areas of the worksite 100 according to one or more excavation plans i.e. the machine 102 may be configured to form piles of material on the worksite 100. More specifically, the controller 132 of the machine 102 may be configured to determine a location, size, and shape of a plurality of piles to be deposited onto an intended working surface 124 (as illustrated in FIG. 4) of the worksite 100 along a plurality of spaced apart locations.

Figure 4:
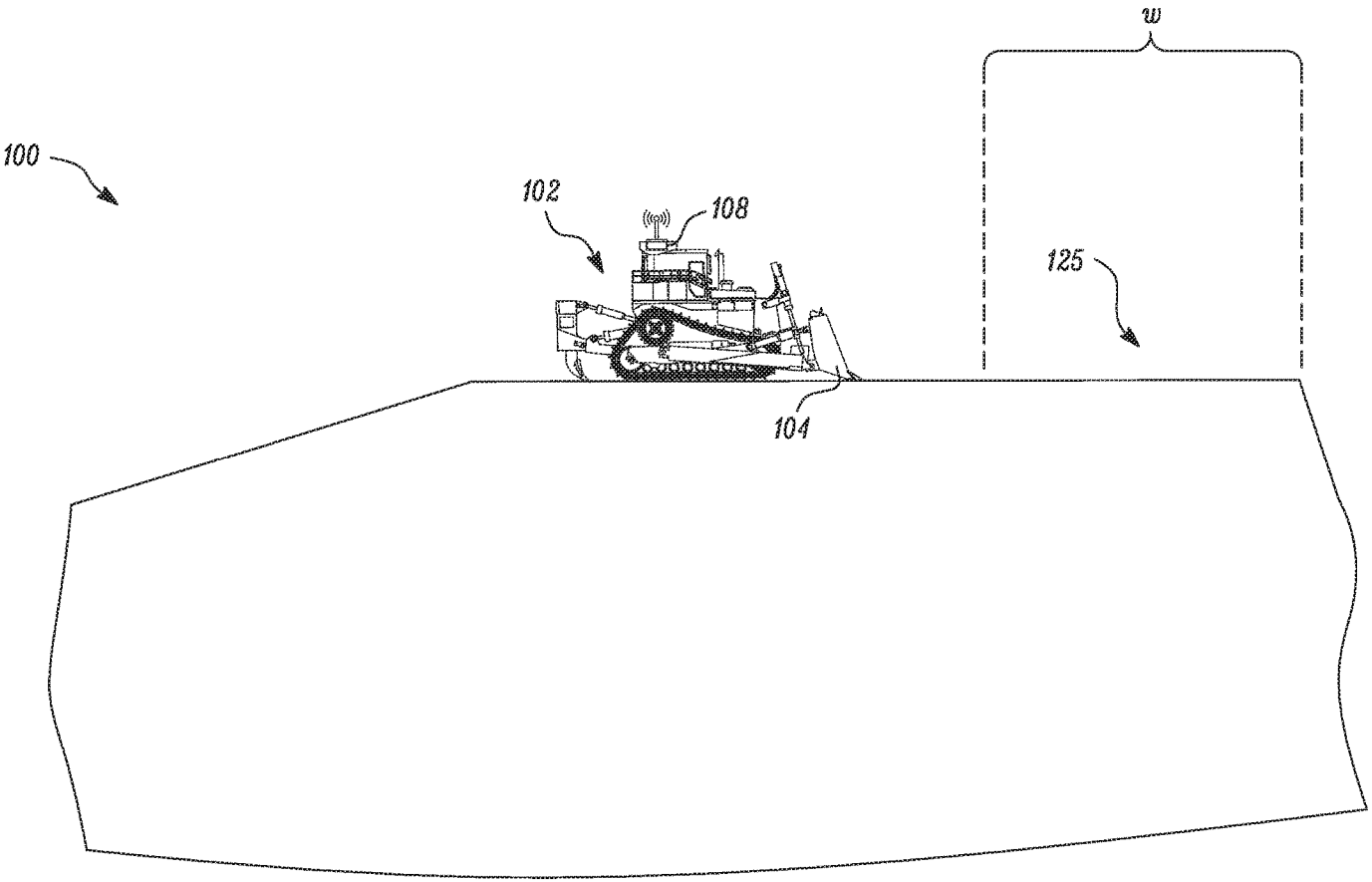
FIG. 4 illustrates the machine configured to operate on a work zone of the worksite, in accordance with an embodiment of the present disclosure.
Figure 5:
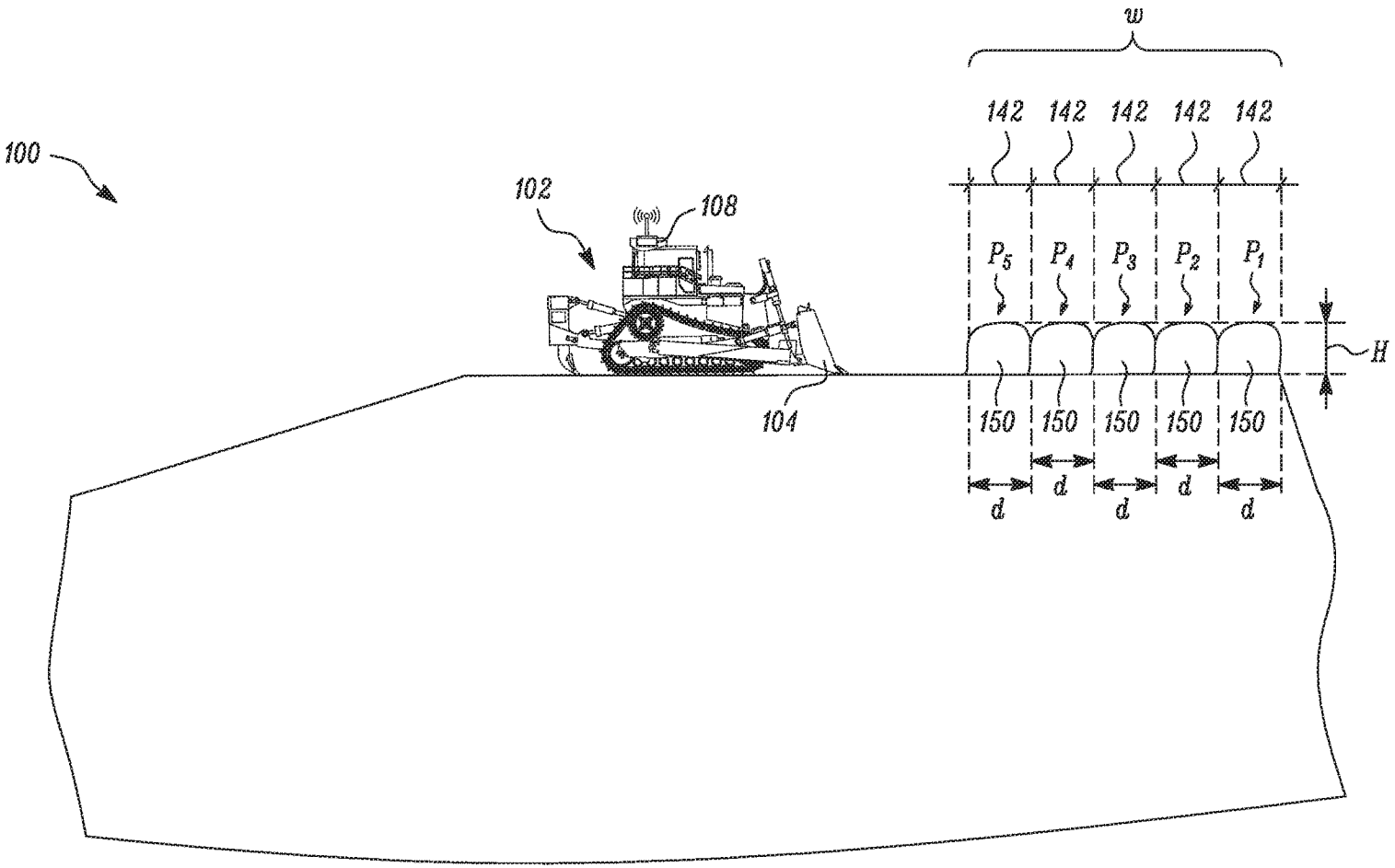
FIG. 5 illustrates a planned pile spacing, in accordance with an embodiment of the present disclosure.

For example, as illustrated in FIG. 5, the pile spacing system 130 may be configured to generate a signal to activate the machine 102 and form five piles (P1, P2, P3, P4, and P5) in an area of a work zone 125 (illustrated in FIG. 4). Each of the five piles (P1, P2, P3, P4, and P5) is desired to be of a predefined size (i.e. having a predefined height 'H') and having a predefined volume of material (i.e. threshold volume 150). Further, each of the piles P1, P2, P3, P4, and P5 is configured to occupy a predefined deposit-area 142 on the work zone 125 of the worksite 100. The information pertaining to the area of the work zone 125, predefined deposit-area 142 and the threshold volume 150 of material may be pre-stored within the memory 134 (as illustrated in FIG. 2).

Figure 3:
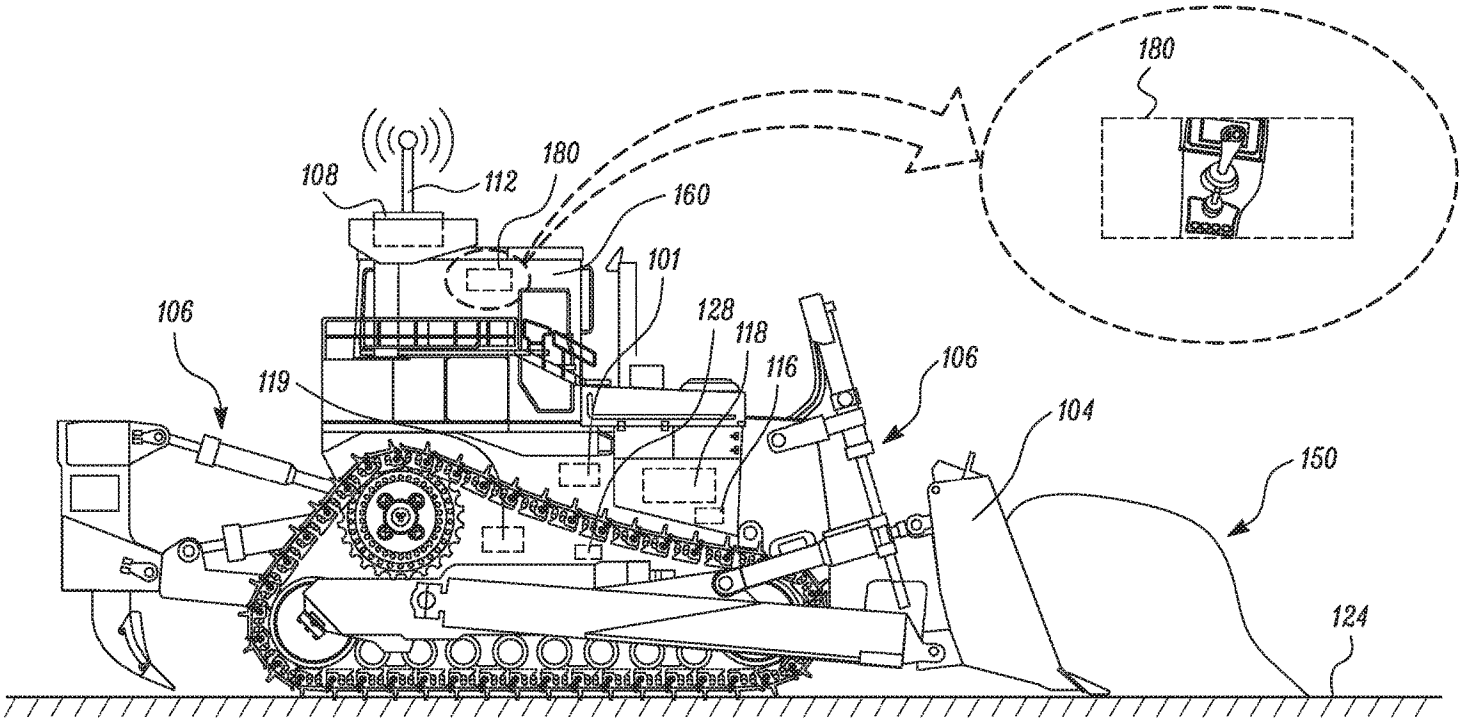
FIG. 3 illustrates a work implement of the machine transporting a volume of material.

In the embodiment illustrated, the work zone 125 is a predefined/predetermined zone of the worksite 100, stored in the memory 134, where the machine 102 is configured to form the piles. However, in an alternate embodiment, an operator present in the operator cabin 160 may input the work zone 125 via an input device 180 present in the operator cabin 160, as illustrated in FIG. 3. In yet another embodiment, operator may input the work zone 125 via the computing device 122.

For the purpose of better understanding it is assumed that the area of the work zone 125 is 200 $m^2$ wherein the length of the area of the work zone 125 (i.e. the parameter of area extending into the plane of the paper) is 10 m and the width of the area of the work zone 125 is 20 m (the width of 20 m being denoted by 'w' in FIG. 4). The pile spacing system 130 may have planned forming the piles P1, P2, P3, P4, and P5 such that each of the five piles (P1, P2, P3, P4, and P5) has a threshold volume 150 of material distributed over the deposit-area 142 (having length of 10 m and width of 4 m), as illustrated in FIG. 5. Since FIG. 5 illustrates a side view the of the piles P1, P2, P3, P4, and P5, only the width 'd' of the deposit-area 142 is visible (i.e. 4 m in the example illustrated). It may be contemplated that the length of the pile extends into the plane of the paper and accordingly is not visible in the illustration. Further, in the illustrations the deposit-area 142 has been illustrated by a linear dimension. However, it may be visualized that the linear dimension may extend orthogonally into the plane of the paper by a predefined distance (i.e. by a distance of 10 m) to form the deposit-area 142.

Each of P1, P2, P3, P4, and P5 has the same height 'H' as each pile is configured to include the same volume of material i.e. the threshold volume 150 distributed over equal deposit-areas 142, as illustrated in FIG. 5.

The operation of the machine 102 will now be explained with reference to FIG. 3, FIG. 5, FIG. 6, and FIG. 7. The controller 132 may commence operation of the machine 102 by generating an operation signal to activate the machine 102. Upon activation, the machine 102 instructs the work implement 104 to engage with the working surface 124. The machine 102 then moves towards the deposit-area 142 to collect the threshold volume 150 of material in the work implement 104. However, due to unavoidable factors such as depressions, crests, shedding of material during operation etc., the machine 102 may collect a volume of material that is either greater than or less than the threshold volume of material 150. When such volume (a volume not equal to the threshold volume 150) is deposited on the deposit-area 142, the pile formed may not have the height 'H' that is planned by the controller 132. For example, the machine 102 may collect a volume of material that is greater than the threshold volume 150. If such volume of material is deposited on the deposit area to form a pile then the pile will have a height which is more than the height 'H'. The machine 102 may then form the pile P2 of height 'H'. Compaction of such piles of unequal height may produce an uneven surface having an unplanned height.

The pile spacing system 130 of the present disclosure obviates the production of an uneven surface having an unplanned height. The pile spacing system 130 adjusts area to be occupied by the pile depending on the volume of the material transported/collected by the machine 102. The pile spacing system 130 is then configured to command the machine 102 to operate and form the first pile. The pile spacing system 130 is then configured to detect first area occupied by the first pile deposited in the work zone 125. The pile spacing system 130 is then configured to determine an available area in the work zone 125 based on a comparison of the first area with the area of the work zone 125. The pile spacing system 130 then determines a remaining number of piles to be deposited in the available area based on the determination of the available area. The pile spacing system 130 then determines a location for each pile of the remaining number of piles to be deposited in the available area such that each pile of the remaining number of piles are evenly spaced from each other. The pile spacing system 130 then generates a machine signal to operate the machine 102 to form the remaining number of piles at the respective determined location.

The detailed explanation of how the controller 132, of the pile spacing system 130, performs the above-mentioned steps/functions will now be explained in detail with reference to FIG. 1-FIG. 14. During operation of the machine 102 on the worksite 100, the controller 132 of the pile spacing system 130 is configured to receive machine signals from the one or more machine sensors i.e. the engine sensor 118 and the slip sensor 119, as illustrated in FIG. 2. Based on the machine signals, the controller 132 of the pile spacing system 130 is configured to determine a volume of material transported by the machine 102.

For the sake of better understanding, the step of determining the volume of material transported by the machine 102 will now be explained in detail with reference to an example. The machine 102 may produce a torque T1 to move on the working surface 124 of the worksite 100 at a specific speed under no load conditions (i.e. when the machine 102 is not transporting/collecting material). Such information may already be pre-stored in the memory 134. Now, when the machine 102 is operating at the worksite 100 to transport material to form pile at the deposit-area 142 a torque T2 may be generated to move the machine 102.

The controller 132 receives the torque value T2 from the engine sensor 118 and compares it with the torque value T1. The controller 132 deduces that the value T2 is greater than the value T1 as T2 is the torque value when the machine 102 is working in a loaded condition (i.e. transporting material). The controller 132 computes the difference between T2 and T1 and applies a set of algorithms/computations (stored in the memory 134) on the difference between T2 and T1 to determine the volume of material that is being transported by the machine 102.

Figure 6:
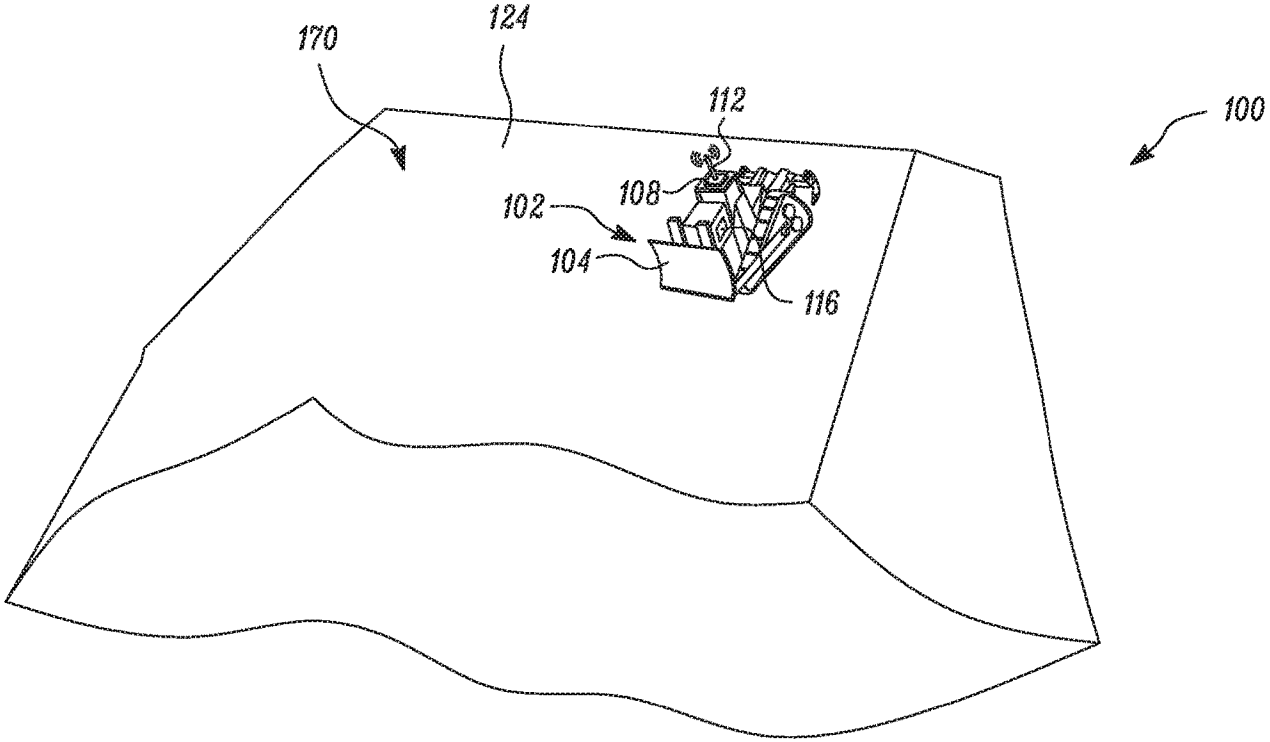
FIG. 6 illustrates a terrain of the worksite before operation of the machine to collect material within the work implement, in accordance with an embodiment of the present disclosure.
Figure 7:
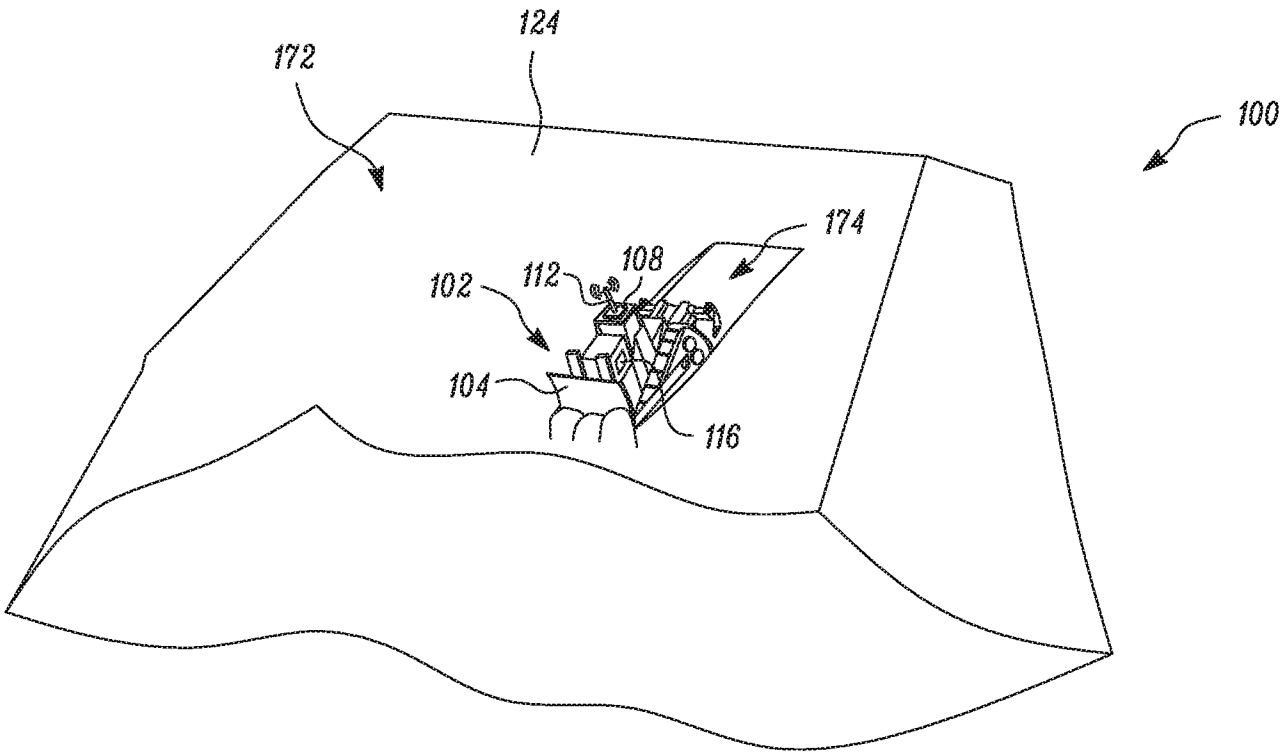
FIG. 7 illustrates a terrain of the worksite after a start of operation of the machine to collect material within the work implement, in accordance with an embodiment of the present disclosure.

In an alternate embodiment, the volume of material transported by the machine 102 may be determined by monitoring the terrain of the worksite 100 i.e. the working surface 124 before the material is collected in the work implement 104 and after the material has been deposited on the working surface 124, as illustrated in FIG. 6 and FIG. 7. For example, the control system 108 and/or the pile spacing system 130 may receive the perception data from the perception module 128 before and after operation of the machine 102 to form pile. Based on the perception data, the control system 108 and/or the pile spacing system 130 determine the terrain features on the working surface 124. For the purpose of better understanding, it is assumed that the working surface 124 has a terrain 170 before operation of the machine 102 to collect material in the work implement 104. Further, it is assumed that the working surface 124 has a terrain 172 after the machine 102 has collected material in the work implement 104. The controller 132 receives information pertaining to the terrain 170 and 172. The controller 132 now compares the terrain 172 with the terrain 170. Based on this comparison, the controller 132 determines that a cut has been made on the terrain 170 by the work implement 104 (the cut being illustrated by reference numeral 174 in the terrain 172). The controller 132 concludes that the cut 174 was made when the work implement 104 engaged with the terrain 170, during machine 102 operation, to collect material therein. The controller 132 concludes that the cut 174 has a volume which is equal to the volume collected in the work implement 104. The controller 132 then calculates the volume of the cut 174 based on the comparison of the terrain 170 and 172. The calculated volume of the cut 174 is then stored in the memory 134 as the volume collected in the work implement 104.

The controller 132 now compares the determined volume of material with the threshold volume 150. If the determined volume of material is equal to the threshold volume 150, the controller 132 determines that the determined volume is to be deposited on the deposit-area 142 to form pile P1 as shown in FIG. 5.

Figure 9:
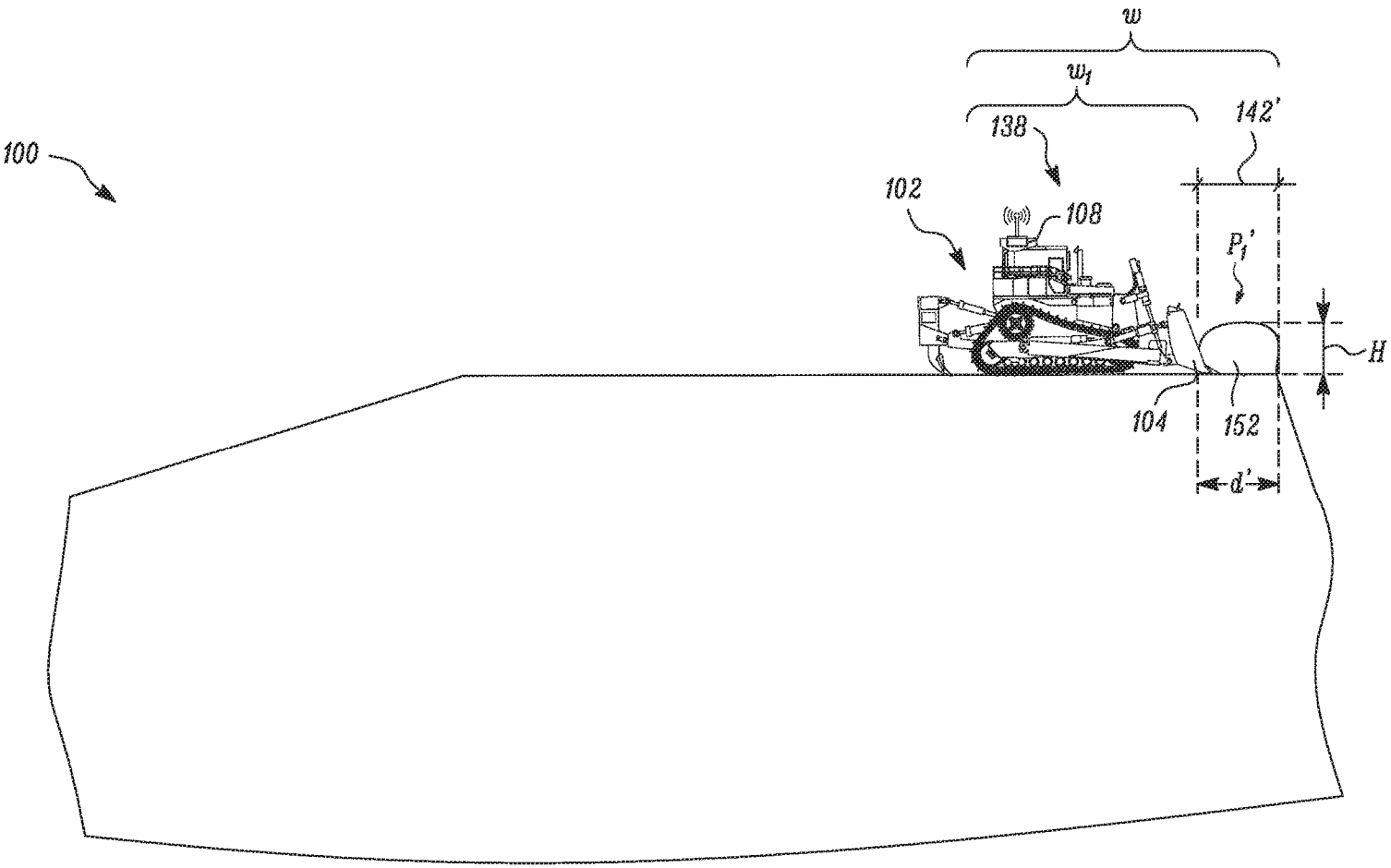
FIG. 9 illustrates the machine depositing the volume of material greater than the threshold volume of material to form pile, in accordance with an embodiment of the present disclosure.

In case the determined volume of material is not equal to the threshold volume 150, the controller 132 determines at least one parameter associated with the pile to be formed by the determined volume. The at least one parameter is determined such that the pile to be formed by the determined volume has a height that is equal to the height 'H', as illustrated in FIG. 9.

The at least one parameter associated with the pile to be formed by the determined volume may correspond to the dimensions of the pile to be formed, on the working surface 124. For example, the at least one parameter may correspond to the area occupied on the working surface 124 when the determined volume of material is deposited to form the pile having the height 'H'. In an alternate example, the at least one parameter may correspond to one or more of length and width of the pile that is formed when the determined volume of material is deposited on the working surface 124 to form the pile having height 'H'. The controller 132 then operates the machine 102 to deposit the determined volume based on the at least one parameter to form the pile having height 'H'.

Figure 8:
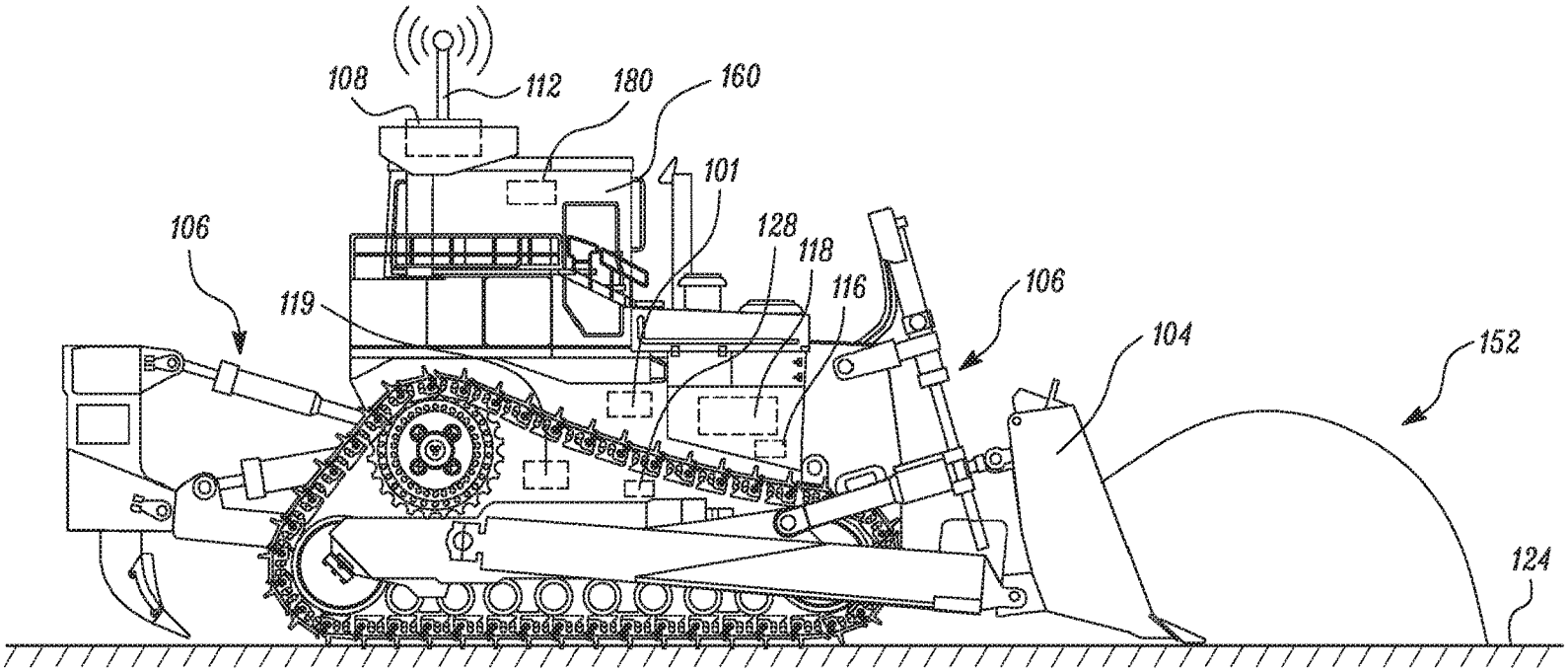
FIG. 8 illustrates the work implement of the machine transporting a volume material greater than the threshold volume of material, in accordance with an embodiment of the present disclosure.

For the purpose of better understanding the above-mentioned operation of the controller 132, will now be explained with reference to an example, illustrated in FIG. 8-FIG. 9. It is assumed that that the threshold volume 150 is 400 m3 and this threshold volume 150 is configured to be deposited on the deposit-area 142 (having length 10 m and width 4 m, as mentioned above). Thus, the height 'H' of the pile formed when the threshold volume 150 is deposited on the deposit-area 142 comes out to be 10 m.

During operation of the machine 102 to form piles, the controller 132 detects/determines the volume of material transported by the machine 102 by using the techniques as discussed above. The determined volume of material in the work implement 104 of the machine 102, as illustrated in FIG. 8 and FIG. 9 shall hereinafter be referred to by reference numeral 152. For the purpose of ongoing disclosure, it is assumed that the determined volume of material 152 comes out to be 600 m3.

On comparing the determined volume of material 152 with the threshold volume 150, the controller 132 determines that the determined volume of material 152 is 1.5 times the threshold volume 150. The controller 132 designates the determined 1.5 value as a pile depositing factor. The pile depositing factor is a numerical value, which is used to compute certain variables (such as the at least one parameter of the pile to be formed, new deposit area 142') during machine operation. Based on this pile depositing factor of 1.5, the controller 132 determines at least one parameter i.e. one or more of the length and/or width of the pile to be formed by the volume of material 152 such that the height of the pile P1' to be formed by the volume of material 152 comes out to be 'H'.

For example, the controller 132 calculates the new deposit area 142' for the pile to be formed by the determined volume of material 152 by multiplying the pile depositing factor of 1.5 to the magnitude of the deposit-area 142. Thus, the new deposit area 142' comes out to be 60 $m^2$. Based on the new deposit area 142', the controller 132 determines the at least one parameter i.e. a length or/and a width of the new deposit area 142'. For example, in the embodiment illustrated in FIG. 9, the controller 132 determines the length of the new deposit area 142' as 10 m or the width of the new deposit area 142' as 6 m (width of 6 m is denoted by d') In an alternate example, the controller 132 may determine the width of the new deposit area 142' as 10 m and the length of the new deposit area 142' as 6 m. In various other embodiments, the controller 132 may determine different values for the length and width of the new deposit area 142'.

Subsequent to determination of the at least one parameter, the controller 132 generates a signal to operate the machine 102 and deposit the determined volume of material 152 on the new deposit area 142', as illustrated in FIG. 9. Thus, when the machine 102 deposits the determined volume of material 152 i.e. 600 $m^3$ on the new deposit area 142' having area of 60 $m^2$, the pile P1' is formed having height 'H' of 10 m, width of 6 m (denoted by d') and length of 10 m (extending into the plane of the paper), as illustrated in FIG. 9.

After depositing the first pile P1', the controller 132 calculates/determines an available area 138 on the work zone 125 by comparing a first area/new deposit area 142' (hereinafter the first area has been interchangeably referred to by the new deposit area 142') of the first pile P1' with the area of the work zone 125, as illustrated in FIG. 9. The controller 132 then determines the remaining number of piles that may be formed/accommodated on the available area 138. For example, initially as discussed above, the pile spacing system 130 had planned for five piles of equal size (i.e. P1, P2, P3, P4 and P5) to be placed on the area of the work zone 125 i.e. P1, P2, P3, P4 and P5 each having a width of 4 m placed on the work zone 125. However, due to the unavoidable factors listed above, pile P1' may be formed occupying the first area (i.e. new deposit area 142') that is more than the deposit-area 142. As discussed above, the new deposit area 142' has length of 10 m and width of 6 m. In the embodiment illustrated, the first area 142' corresponds to a crest end region of the worksite 100 i.e. the area adjacent to the crest (the highest point from where a valley starts) on the worksite 100, as illustrated in FIG. 9.

The controller 132 then compares the first area 142' with the area of the work zone 125, to determine the available area 138 present in the work zone 125. In the example illustrated, the first area 142' occupies width of 6 m of the work zone 125 (having width 20 m). The controller 132 may now determine that the remaining area of the work zone 125 has a width of 14 m. This available area 138 having width of 14 m may not be able to accommodate piles P2, P3, P4 and P5 (each having width 4 m) as had been initially planned. This is because it may not be possible to form piles P2, P3, P4 and P5 of combined width 16 m on the available area 138 having a width 14 m.

Figure 10:
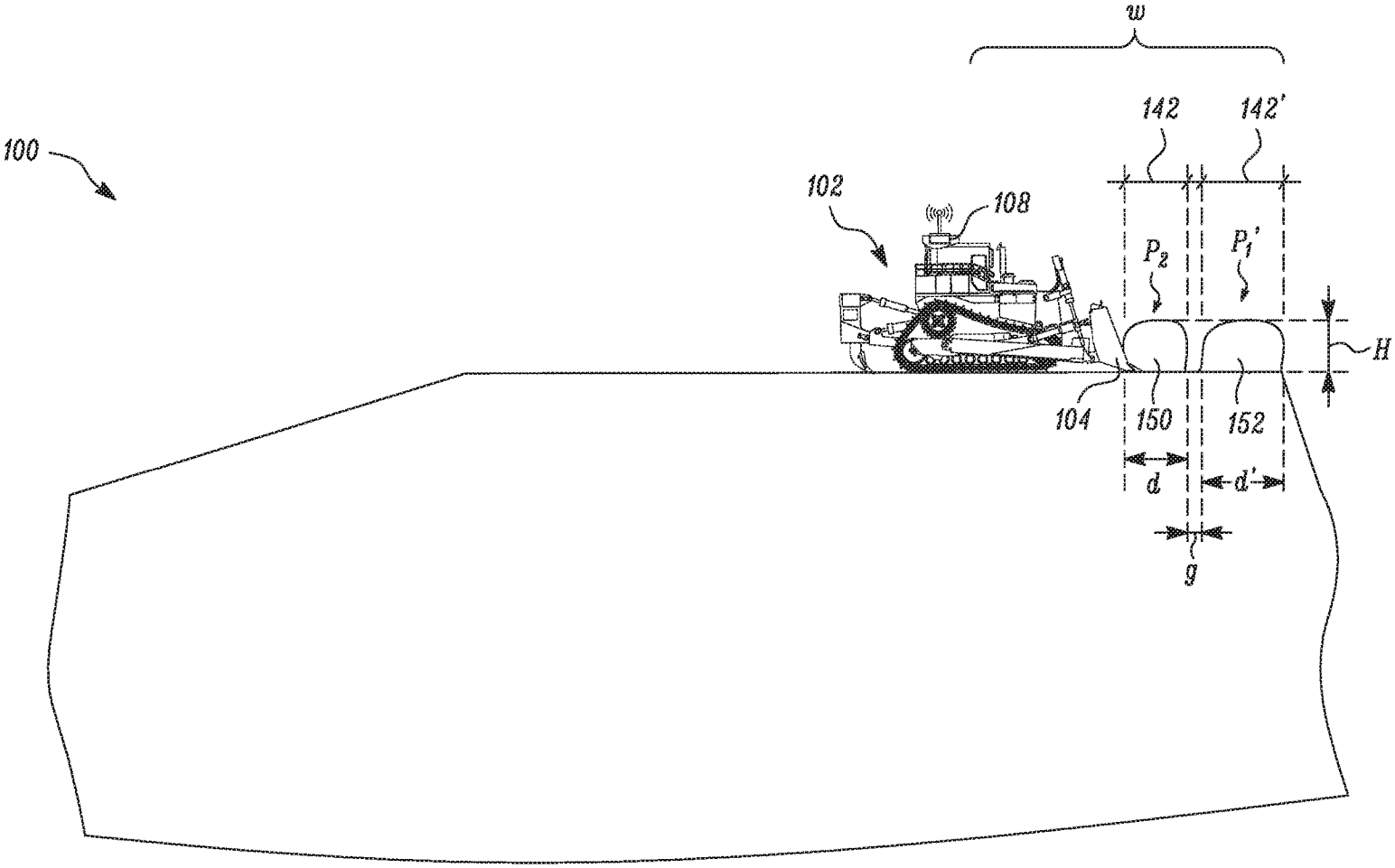
FIG. 10 illustrates the machine depositing the threshold volume of material a deposit areas to form pile, in accordance with an embodiment of the present disclosure.
Figure 11:
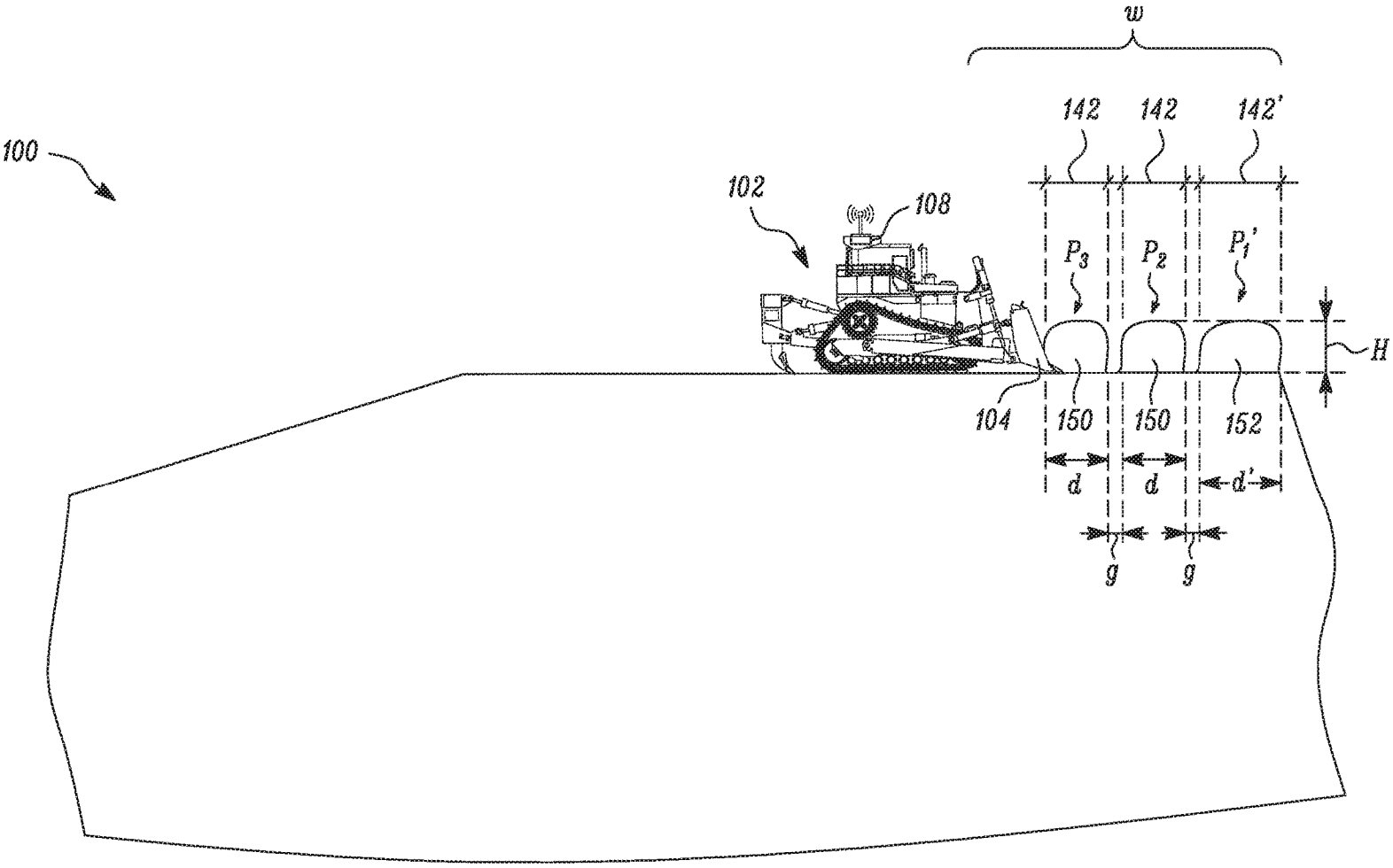
FIG. 11 illustrates the machine depositing the threshold volume of material a deposit areas to form pile, in accordance with an embodiment of the present disclosure.
Figure 12:
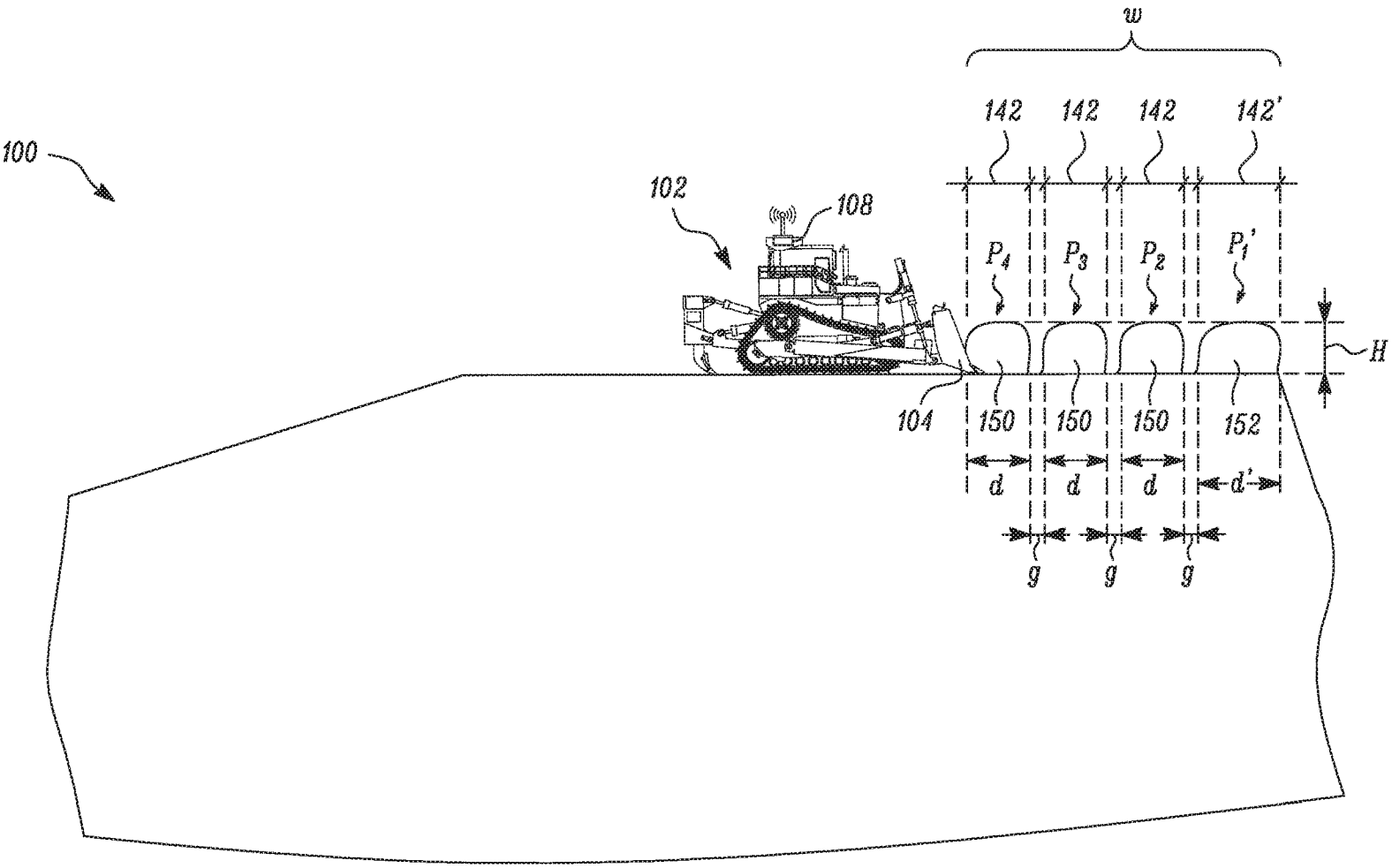
FIG. 12 illustrates the machine depositing the threshold volume of material a deposit areas to form pile, in accordance with an embodiment of the present disclosure.

The controller 132, thus, determines the remaining number of piles that can be accommodated within the available area 138. In the exemplary embodiment illustrated, the controller 132 may be able to form/accommodate piles P2, P3 and P4 (each having width of 4 m) on the available area 138 (having width of 14 m) in the work zone 125. The controller 132 then determines the location for each pile of the remaining number of piles i.e. locations for P2, P3 and P4 such that each pile of the piles (P1', P2, P3 and P4) is equally spaced apart from the adjacent pile (i.e. evenly spaced from each other). For example, the piles P2, P3 and P4 (each having a width of 6 m denoted by 'd' in FIG. 12) may be configured to occupy locations on the work zone 125 such that there exists a gap of 0.67 m between pile P1' and P2, P2 and P3, and P3 and P4, as illustrated in FIG. 10, FIG. 11 and FIG. 12. Thus, the locations for the piles P2, P3 and P4 are determined, by the controller 132, such that the sum of area taken by piles P2, P3 and P4 (to be formed) and the area taken by the gap 'g' present between P1' and P2, P2 and P3, and P3 and P4 is equal to the available area 138. The controller 132 may then operate the machine 102 to form the remaining piles (i.e. P2, P3 and P4) at their respective determined locations.

In the embodiment illustrated, the steps, of determining the available area 138 on the work zone 125, determining the remaining number of piles to be formed on the available area 138 of the work zone 125 and determining the locations for each of the remaining number of piles on the available area 138, are performed after formation of the first pile P1' on the work zone 125. However, it may be contemplated that the above-mentioned steps may be executed after formation of the second pile P2, third pile P3 and fourth pile P4.

Figure 13:
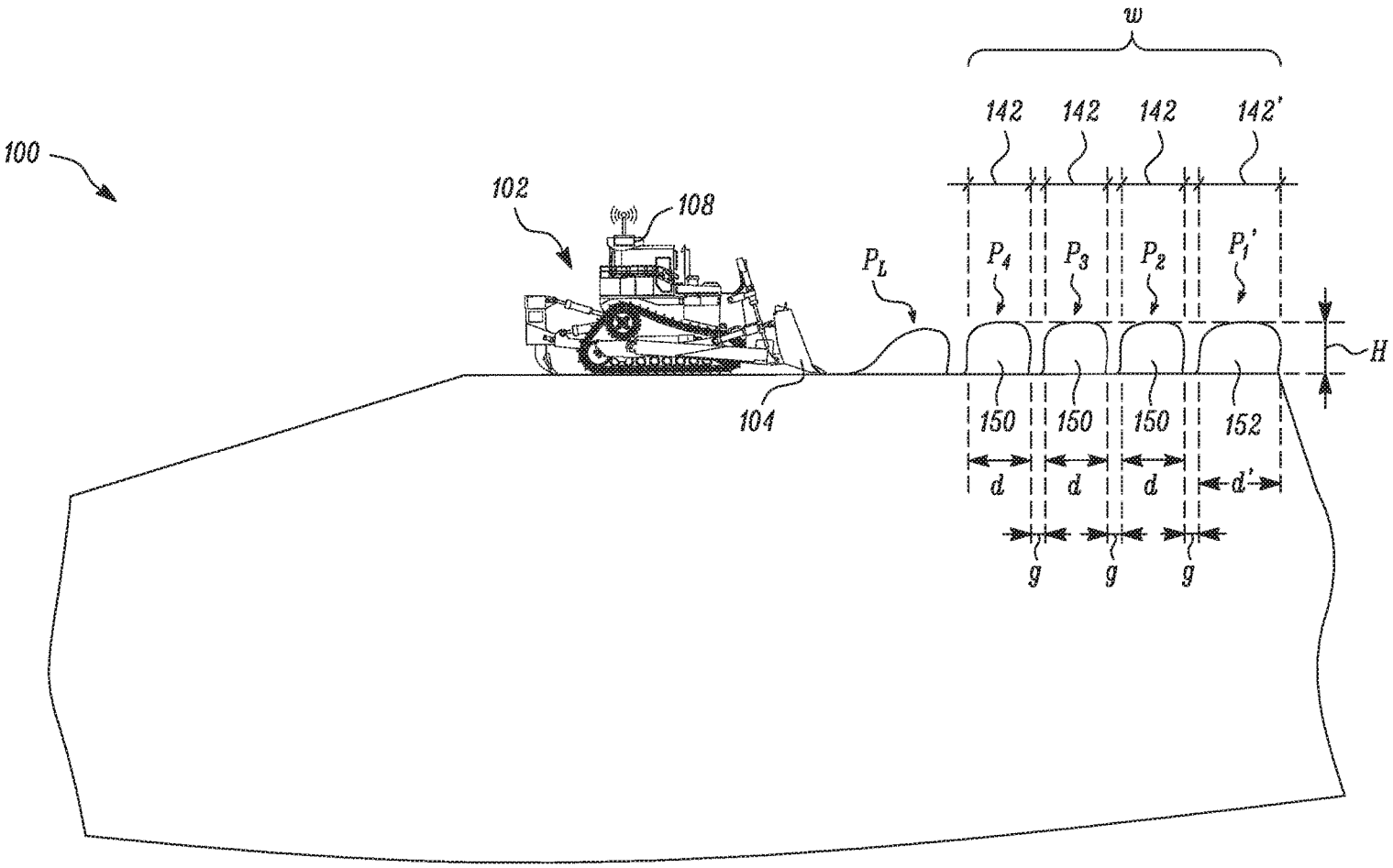
FIG. 13 illustrates the machine depositing material to form a substantially triangular pile, in accordance with an embodiment of the present disclosure.
Figure 14:
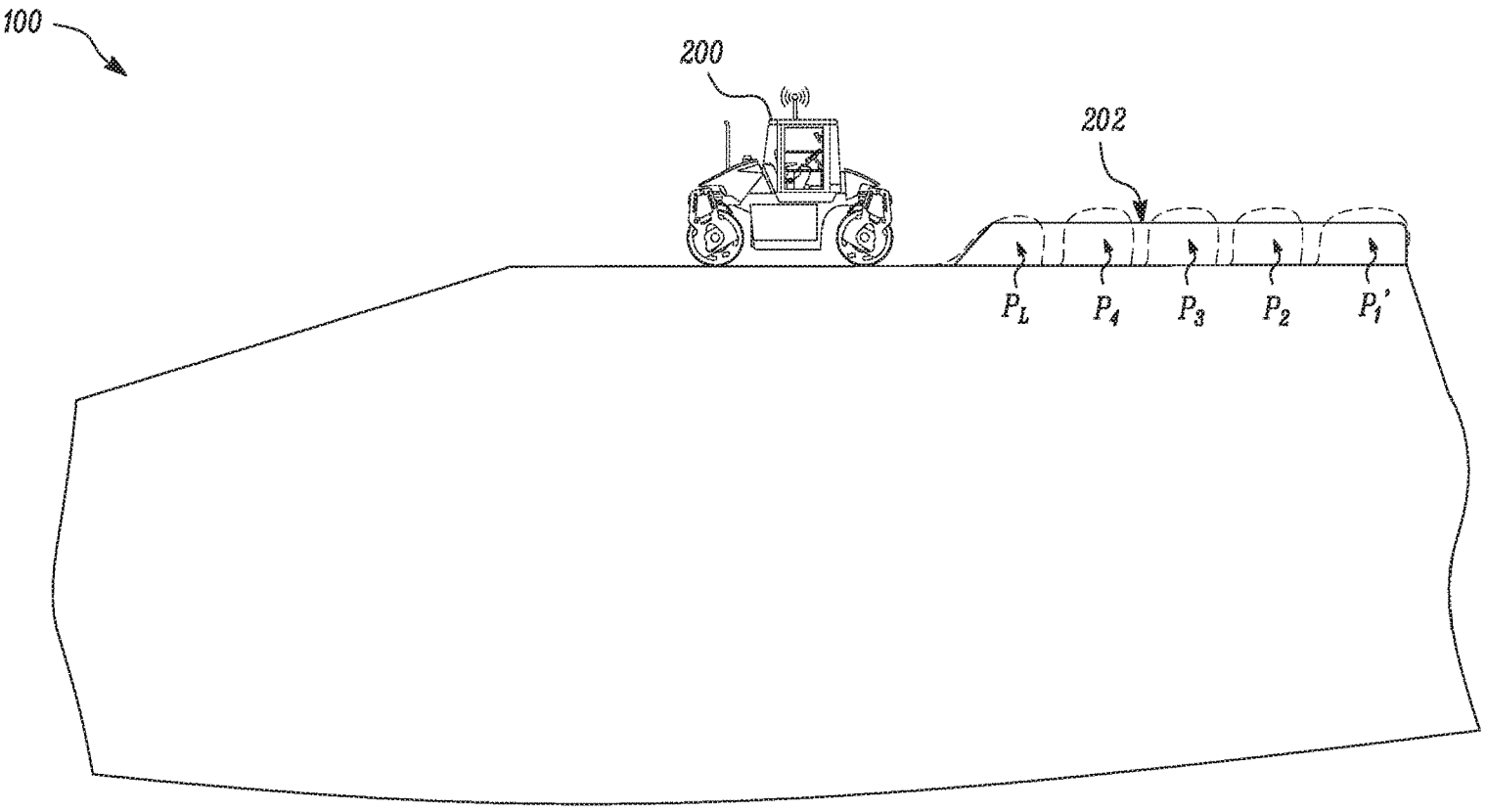
FIG. 14 illustrates a compaction machine compacting the piles formed on the work zone to produce a smooth surface, in accordance with an embodiment of the present disclosure.

In the embodiment illustrated in FIG. 13, the controller 132 may issue a ramp signal to the machine 102 to form a last pile $P_L$ adjacent to the pile P4 such that the pile $P_L$ is spaced from pile P4 by a predefined distance. The pile $P_L$ is formed such that it has a substantially triangular shape, as illustrated in FIG. 13. The pile $P_L$ is configured to form an inclined ramp surface (having a positive slope of low magnitude i.e. 10-30 degrees) upon compaction by a compaction machine 200. In the embodiment illustrated, the compaction machine 200 is communicably coupled to the controller 132. The controller 132 is configured to issue a ramp formation signal to activate the compaction machine 200 and compact the pile $P_L$ to form the inclined ramp surface, as illustrated in FIG. 14.

The controller 132 may then issue a compaction signal to the compaction machine 200 to compact the piles P1', P2, P3, P4 after formation of the said piles (i.e. P1', P2, P3, P4) to produce a smooth surface 202.

The ramp facilitates the compaction machine 200 to climb to a height that is substantially the same height as of the piles P1', P2, P3 and P4. Thus, the compaction machine 200 may effectively compact the piles P1', P2, P3 and P4 to form the smooth surface 202, as illustrated in FIG. 14 (as in the absence of the ramp the compaction machine 200 may not be able to compact the piles having height 'H' because the compaction machine 200 may not have the power to climb from the working surface 124 to a sudden height of the piles i.e. height 'H').

In the embodiment illustrated, the pile P1' is formed by depositing material on the first area (i.e. the new deposit area 142'). However, in an alternate embodiment, the pile P1' may be formed by another machine 102 (as illustrated in FIG. 1) operating at the worksite 100 to form the pile P1' in the first area/new deposit area 142'. After deposition of material by another machine 102 to form pile P1', the controller 132 may detect the area occupied by the pile P1'. In an embodiment, the area occupied by the pile P1' may be detected by using the perception module 128. The perception module 128 may transmit the information pertaining to the area, occupied by the pile P1', to the controller 132 upon a request initiated by the controller 132. In an alternate embodiment, another machine 102 that formed the pile P1' on the work zone 125 may have stored the details pertaining to the area occupied by the pile P1' in the memory 134. After detecting/determination of the first area 142' occupied by the first pile P1', the controller 132 compares the first area 142' with the area of the work zone 125 to determine the available area 138. The controller 132 may then operate the machine 102 to determine the remaining number of piles, determine the locations for each pile of the remaining number of piles and the then generate the machine signal to form the piles remaining number of piles as illustrated in FIG. 12.

INDUSTRIAL APPLICABILITY

Dozer machines may be configured to push material and form piles at a location on the worksite. It is sometimes desired to have a certain number of piles, which are substantially of equal size (for example, similar height), to be positioned at regular intervals along a defined distance. However, in operation the dozer may not form piles of equal sizes due to variables such as depressions on the work surface, shedding of material, etc. Accordingly, piles of varying sizes may be positioned at regular intervals along a defined distance. Compaction of such piles may form an uneven surface, which may be undesirable.

Figure 15:
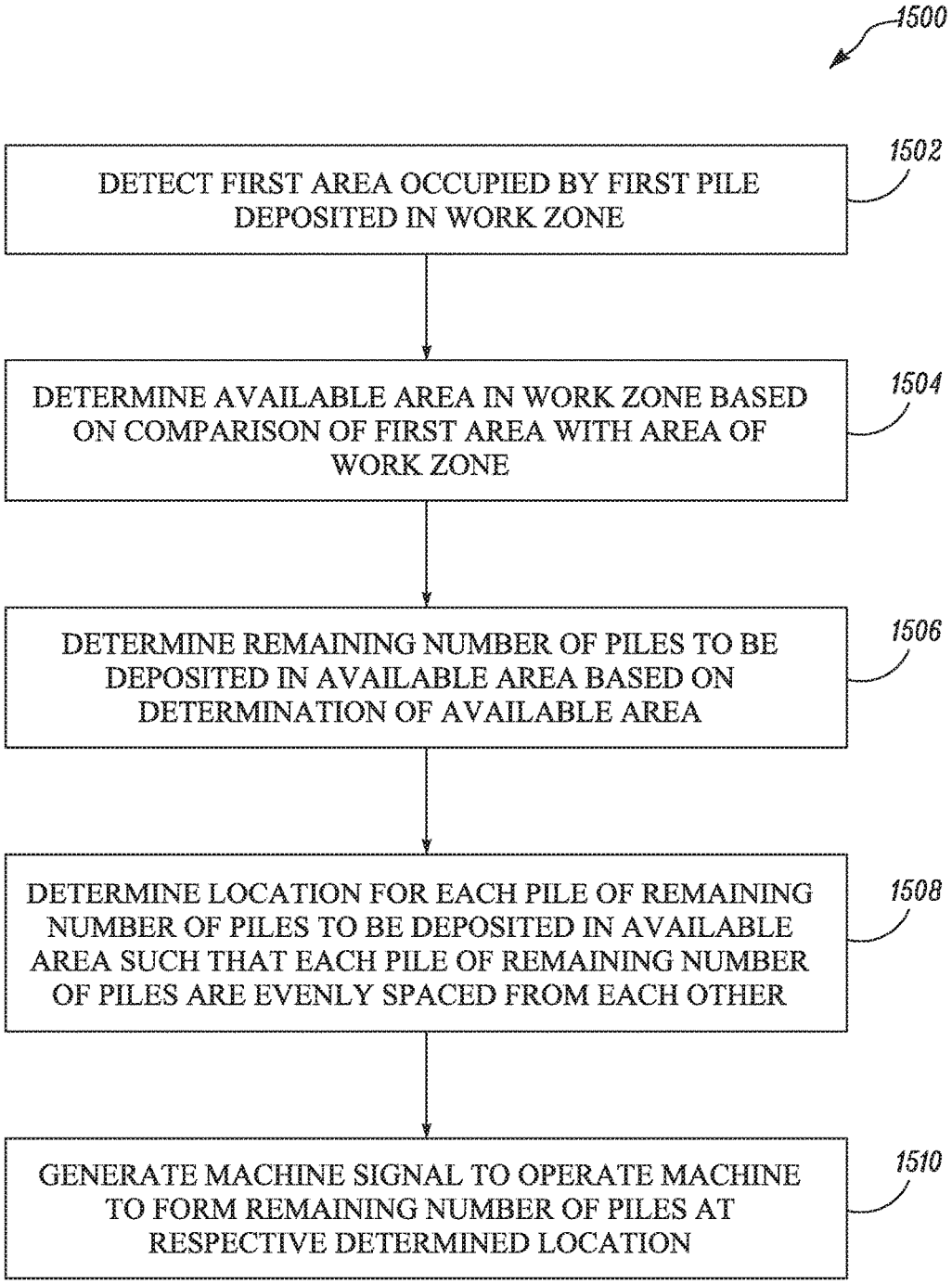
FIG. 15 depicts a method of operating the machine at the worksite in accordance with an embodiment of the present disclosure.

The present disclosure discloses a method 1500 for depositing pile of material by the machine 102 at the worksite 100, as illustrated in FIG. 15. The machine 102 includes the pile spacing system 130 having the controller 132. The controller 132 is configured to detect the first area/new deposit area 142' occupied by the first pile P1' in the work zone 125 (Step 1502). The controller 132 then determines the available area 138 in the work zone based on the comparison of the first area/new deposit area 142' with the area of the work zone 125 (Step 1504). The controller 132 then determines the remaining number of piles to be deposited in the available area 138 based on the determination of the available area 138 (Step 1506). The controller 132 then proceeds to determining the location for each pile of the remaining number of piles to be deposited in the available area 138 such that each pile of the remaining number of piles are evenly spaced from each other (Step 1508). The controller 132 then generates the machine signal to operate the machine 102 to form the remaining number of piles at the respective determined location (Step 1510).

Using the method 1500 the operator in the worksite 100 or at the command center 120 can form multiple piles on the working surface 124 wherein upon compaction of the multiple piles a smooth surface is produced. Such smooth surfaces may be aid the machine 102 to perform its operation in an optimal manner. Further, implementation of this method 1500 using the pile spacing system 130 of the present disclosure, automates the process of forming piles of material on the worksite 100. Such an automated process reduces the time spent by the operator to operate the machine 102 to achieve the desired result. The time saved by the operator, due to automation of the process, may be used in other aspects of the operation to improve productivity.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A method for depositing piles of material, by a machine, in a work zone of a worksite, the method comprising:

detecting, by a controller, a first area occupied by a first pile deposited in the work zone;

determining, by the controller, an available area in the work zone based on a comparison of the first area with an area of the work zone;

determining, by the controller, a remaining number of piles to be deposited in the available area based on the determination of the available area;

determining, by the controller, a location for each pile of the remaining number of piles to be deposited in the available area such that each pile of the remaining number of piles are evenly spaced from each other; and generating, by the controller, a machine signal to operate the machine to form the remaining number of piles at the respective determined location.

2. The method of claim 1 wherein the first pile is deposited by the machine in the first area.

3. The method of claim 1 further comprising generating, by the controller, a ramp signal to operate the machine and form a substantially triangular pile adjacent to the remaining number of piles.

4. The method of claim 3 further comprising generating a ramp formation signal to operate a compaction machine and compact the substantially triangular pile to form an inclined ramp surface having a positive slope.

5. The method of claim 1 further comprising generating a compaction signal to operate a compaction machine to compact the first pile and the remaining number of piles to produce a smooth surface.

6. The method of claim 1, wherein the first pile is deposited in the first area by another machine operating at the worksite.

7. The method of claim 1 wherein the work zone is defined based on one of an operator input and/or a predetermined zone of the worksite.

8. A pile spacing system for a machine operating at a worksite, the pile spacing system comprising:

a controller operatively coupled to the machine, the controller configured to:

detect a first area occupied by a first pile deposited in a work zone, in the worksite;

determine an available area in the work zone based on a comparison of the first area with an area of the work zone;

determine a remaining number of piles to be deposited in the available area based on the determination of the available area;

determine a location for each pile of the remaining number of piles to be deposited in the available area such that each pile of the remaining number of piles are evenly spaced from each other; and generate a machine signal to operate the machine to form the remaining number of piles at the respective determined location in the available area.

9. The pile spacing system of claim 8, wherein the first pile is deposited by the machine in the first area.

10. The pile spacing system of claim 9, wherein the first area is a crest end region of the work zone.

11. The pile spacing system of claim 8, wherein the controller is further configured to generate a compaction signal to operate a compaction machine, operating at the worksite, for compacting the first pile and the remaining number of piles to produce a smooth surface.

12. The pile spacing system of claim 8, wherein the first pile is deposited in the first area by another machine operating at the worksite.

13. The pile spacing system of claim 8 wherein the controller is further configured to generate a ramp signal to operate the machine and form a substantially triangular pile proximate to the remaining number of piles.

14. A machine configured to operate at a worksite, the machine comprising:

a controller operatively coupled to the machine, the controller configured to:

detect a first area occupied by a first pile deposited in a work zone, in the worksite;

determine an available area in the work zone based on a comparison of the first area with an area of the work zone;

determine a remaining number of piles to be deposited in the available area based on the determination of the available area;

determine a location for each pile of the remaining number of piles to be deposited in the available area such that each pile of the remaining number of piles are evenly spaced from each other; and generate a machine signal to operate the machine to form the remaining number of piles at the respective determined location in the available area.

15. The machine of claim 14 wherein the first pile is deposited by the machine in the first area.

16. The machine of claim 15 wherein the first area is a crest end region of the work zone.

17. The machine of claim 14 wherein the first pile is deposited in the first area by another machine operating at the worksite.

18. The machine of claim 14 further comprising an input device configured to allow an operator to define the work zone in the worksite.

19. The machine of claim 14, wherein the controller is further configured to generate a compaction signal to operate a compaction machine, operating at the worksite, for compacting the first pile and the remaining number of piles to produce a smooth surface.

20. The machine of claim 14 wherein the controller is further configured to generate a ramp signal to operate the machine and form a substantially triangular pile proximate to the remaining number of piles.

* * * * *